US005370933A

United States Patent [19]

Govindan

[11] Patent Number: 5,370,933

[45] Date of Patent: Dec. 6, 1994

[54] SOIL RELEASE COMPOSITION FOR USE WITH POLYESTER TEXTILES

[75] Inventor: Cheruthur Govindan, Murrysville, Pa.

[73] Assignee: PPG Industries, Inc., Pittsburgh, Pa.

[21] Appl. No.: 830,044

[22] Filed: Jan. 31, 1992

[51] Int. Cl.[5] ..... B32B 33/00; D06M 15/41; D06M 15/507; D06M 15/53

[52] U.S. Cl. ..... 428/272; 252/8.9; 427/393.4; 428/395

[58] Field of Search ..... 428/272, 395; 252/8.9; 427/393.4

[56] References Cited

U.S. PATENT DOCUMENTS

| | | | |
|---|---|---|---|
| 3,416,952 | 12/1968 | McIntyre et al. . | |
| 3,446,734 | 5/1969 | Coats | 252/8.9 |
| 3,557,039 | 1/1971 | McIntyre et al. . | |
| 3,712,873 | 1/1973 | Zenk . | |
| 3,919,097 | 11/1975 | Park | 252/8.9 |
| 3,959,280 | 5/1976 | Furukawa et al. . | |
| 4,069,160 | 1/1978 | Hawkins | 252/8.9 |
| 4,127,490 | 11/1978 | Newkirk et al. | 252/8.9 |
| 4,325,890 | 4/1982 | Reitz et al. . | |
| 4,453,002 | 6/1984 | Maurer et al. | 562/429 |
| 4,470,914 | 9/1984 | Thir et al. | 252/8.9 |
| 4,702,857 | 10/1987 | Gosselink | 252/174.21 |
| 4,787,989 | 11/1988 | Fanelli et al. | 252/8.6 |
| 4,877,538 | 10/1989 | Kirjanov et al. | 252/8.9 |
| 4,908,039 | 3/1990 | Holland et al. | 8/137 |
| 4,999,128 | 3/1992 | Sonenstein | 252/174.14 |
| 5,032,136 | 7/1991 | Fitzgerald et al. | 8/115.6 |
| 5,234,753 | 8/1993 | Williams | 252/8.9 |

*Primary Examiner*—James C. Cannon
*Attorney, Agent, or Firm*—Irwin M. Stein

[57] ABSTRACT

Disclosed is a soil release composition for application to or finishing on polyester textile that is heat set at a temperature of 375° F. (191° C.) or higher, said composition comprising a non-fiber forming polyester-polyether copolymer and an antioxidantly effective amount of an acid catalyzed phenol-formaldehyde condensation product of the Novolak type.

17 Claims, No Drawings

SOIL RELEASE COMPOSITION FOR USE WITH POLYESTER TEXTILES

BACKGROUND OF THE INVENTION

Synthetic polymeric textiles, e.g., polyester textiles, are commonly used in a wide variety of consumer and industrial applications. These polyester fabrics are predominantly copolymers of ethylene glycol and terephthalic acid, and are sold under a number of trade names, e.g., Dacron®, Fortrel®, Kodel® and Blue C Polyester®. One disadvantage of polyester textiles is the difficulty in removing oily residues, i.e., naphthenic, aliphatic or alkane hydrocarbon residues, such as motor oil, tar, pitch, lubricating oil or the like, from the material once it has been soiled with such residues. This is in part due to the hydrophobic nature of the polyester textile which makes the material difficult to wet with aqueous solutions of laundering detergents.

As a result, soil release compositions have been developed for application to polyester textiles. These soil release compositions, which are typically comprised of non-fiber forming polyether-polyester copolymers, impart soil release properties by modifying the polyester textile surface to enable release and removal of oily residues from the polyester textile using conventional aqueous laundering techniques. Typical polymeric soil release compositions are described in various U.S. patents, e.g., U.S. Pat. No. 3,416,952.

To impart anti-wrinkle properties and to control dimensional stability, e.g., shrinkage, of polyester textiles, the textile is thermally treated or heat set. Heat setting aligns the crystal morphology of the polyester fibers to a more parallel rather than random orientation. In modern polyester textile processing mills, heat setting is typically effected at a temperature of at least about 375° F. (191° C.) to speed throughput and to better control fabric shrinkage. Such temperatures may range up to about 405° F. (207° C.) or so. Since the soil release composition is applied to the polyester textile prior to heat setting, an antioxidant is often included in the soil release composition to retard or prevent thermal degradation of the soil release composition during the heat setting step.

As disclosed in the above-mentioned U.S. Pat. No. 3,416,952, antioxidant materials typically used to impart thermal stability to the polymeric soil release compositions described therein include sterically hindered phenols, aromatic amines and organic sulfur compounds. However, none of the antioxidant materials specifically disclosed therein satisfactorily retard or prevent thermal degradation of the polymeric soil release composition at polyester textile heat set temperatures of about 375° F. (191° C.). As a result, polyester textiles finished with such soil release compositions and heat set at such elevated temperatures have unsatisfactory soil release properties resulting in incomplete removal of oil residues from the textile when using conventional aqueous laundering techniques.

DESCRIPTION OF THE INVENTION

The present invention is directed to thermally stable soil release compositions for application to synthetic polymeric textiles, e.g., polyester textiles, particularly polyester textiles that are heat set at a temperature of at least about 375° F. (191° C.). The soil release compositions of the present invention when applied to or finished on polyester textiles prior to heat setting are not only durable at heat set temperatures of at least 375° F. (191° C.), e.g., 395° F. (202° C.), but also enable release of oily residue from the polyester textile when using conventional home laundering techniques.

The term heat set, as used in the present description and claims, means the thermal treatment of a synthetic polymeric textile, typically at a temperature in the range of from about 375° F. (191° C.) to about 405° F. (207° C.), so as to align the crystalline morphology of the polymeric, e.g., polyester, fibers into a more parallel rather than random orientation, thereby imparting wrinkle and shrink resistance to the polymeric textile. Oily residues as used in the present description and claims is intended to mean and include hydrocarbon residues, e.g., naphthenic, aliphatic and alkane hydrocarbons, such as motor oil, pitch, tar, and the like. Conventional laundry techniques are those commonly employed to wash and dry fabrics in washing and drying machines commonly found in the home or commercial laundries using commercially available detergents and laundry aids.

In general, the soil release compositions of the present invention comprise a conventional non-fiber forming polyester-polyether copolymer and a thermal stabilizing amount of a Novolak-type phenol-formaldehyde condensation resin product. Non-fiber forming polyester-polyether copolymers, e.g., polyethylene terephthalate—polyoxyethylene terephthalate (PET-POET) copolymers and their use as soil release promoting agents for polyester textiles are well known to those skilled in the art. Such PET-POET copolymers typically have an average molecular weight in the range of from about 5,000 to about 50,000 and may be prepared, e.g., by the ester interchange and subsequent polymerization of dimethyl terephthalate (DMT) and ethylene glycol (EG) in the presence of a mixed catalyst system, as described, for example, in U.S. Pat. No. 3,557,039. U.S. Pat. No. 3,959,280 describes a similar mode of preparation using polyethylene oxide in addition to the DMT and EG reactants. Such PET-POET soil release promoting copolymers are commercially available from a number of manufacturers.

The polyester-polyether copolymeric material of which the soil release composition of the invention is comprised preferably contains from about 10 to 50% by weight of ethylene terephthalate repeat units and from about 90 to 50% by weight of polyoxyethylene terephthalate repeat units which have been derived from a polyoxyethylene glycol having an average molecular weight of from about 1,000 to about 4,000, e.g., 1,000 to 1,500, and wherein the molar ratio of ethylene terephthalate repeat units to polyoxyethylene terephthalate repeat units is from about 2:1 to 6:1.

A preferred copolymeric material for use in the composition of the invention comprises the reaction product of ethylene glycol, dimethyl terephthalate and a polyoxyethylene glycol containing from 1 to about 50 ethylene oxide repeat units, which may be prepared in the manner described in Example 11 of U.S. Pat. No. 3,416,952, which disclosure is incorporated herein by reference. A particularly preferred copolymeric material of which the soil release composition of the invention is comprised is commercially available from PPG Industries, Inc. under the trademark "Larosol® 214A." This material is available as an aqueous dispersion of the reaction product of ethylene glycol, dimethyl terephthalate and polyoxyethylene glycol.

Another commercially available PET-POET type polymeric composition suitable for use in the present invention is a product sold by ICI America under the trademark, "Milease T." The Milease® T material is believed to be a polymeric composition prepared in accordance with Example 19 of U.S. Pat. No. 3,416,952, which composition contains zinc dinonyldithiocarbamate and 2-alpha-methylcyclohexyl-4,6-dimethylphenol.

The antioxidant material used in the soil release compositions of the present invention is an acid catalyzed phenol-formaldehyde condensation product of the Novolak type. The Novolak resins that may be used as antioxidants in the present invention include the phenol, diphenol and alkyl-substituted phenol, e.g., o-cresol, types. These materials have a melt viscosity in centipoises that range from 600 to 1250 at 257° F. (125° C.) to 4500 to 5100 at 302° F. (150° C.), and a melting point, as determined by the ball and ring method, that ranges from 180° to 187° F. (82° to 86° C.) to 230° to 237° F. (110° to 114° C.). The hydroxyl number of the Novolak resin may range from about 200 to 1000, e.g., 400 to 600; the weight average molecular weight of the Novolak resin may range from about 400 to 3000, e.g., 750 to 2000.

While the phenol-formaldehyde Novolak resin is commonly prepared from phenol, other phenolic starting materials may be used. For example, alkyl-substituted phenols such as the cresols, e.g., o-cresol, xylenols, p-tertiarybutyl phenol and nonyl phenol may be used. Also contemplated is p-phenyl phenol and diphenols such as 1,3-benzenediol, bisphenol A and 2,2-bis(4-hydroxyphenyl) propane. As used in the description and claims herein, the term phenol-formaldehyde resin is intended to mean and include resins prepared using said other phenolic starting material.

The manufacture of Novolak resins is described in the Phenolic Resins section of the Third Edition of *The Kirk Othmer Chemical Encyclopedia,* Vol. 17, pp. 390–399, which pages are incorporated herein *in toto* by reference. In a conventional Novolak resin polymerization, the reactor is charged with molten phenol and formaldehyde at 140°–149° F. (60°–65° C.). The amount of formaldehyde which is charged depends on the resin properties sought, but generally is an amount necessary to provide 0.70–0.85 mole of formaldehyde per mole of phenol. For safety reasons, the acid catalyst is often added in increments, with partial reactions occurring between additions. In other cases, also for safety reasons, the exotherm is controlled by metering formaldehyde into a phenol/catalyst mixture. When the reaction is complete, usually in about six to eight hours, normally greater than 95 weight percent of the phenol is reacted. Water is removed by heat and vacuum. The final phenol content is monitored carefully since free phenol content in the resin is a main determinant of resin properties, e.g., softening point, flow and reaction rate.

The amount of Novolak resin material incorporated in the soil release composition is an antioxidantly (thermal stabilizing) effective amount, i.e., an amount which provides thermal stability to the soil release composition at heat set temperatures of at least 375° F. (191° C.), e.g., 395° F. (202° C.) and which does not adversely affect the soil release properties of the soil release composition. Experimental results indicate at present that, at a level below about 0.5% by weight of Novolak resin, based on the weight of the polyester-polyether copolymeric material, soil release properties of the treated and heat set polyester textile are less than desirable; whereas at a level much above 2.5% by weight of Novolak resin, based on the weight of the copolymeric soil release material, minimal increases in performance are obtained. Consequently, the hereindescribed Novolak resin material is used most advantageously in the invention composition in antioxidantly effective or thermal stabilizing amounts, which advantageously range from about 0.5 to about 5.0% by weight, and preferably from about 0.75 to about 2.5% by weight, based on the weight of the copolymeric soil release material.

Polyester textiles to which the soil resistant composition of the invention may be applied include but are not limited to: dyed or undyed, woven or non-woven, polyester cloth as well as the polyester fiber, filament or yarn used to make such cloth, which polyester fiber may also be blended with varying amounts of natural material, e.g., wool or cotton. The polyesters commonly used as textiles are those fiber forming polyesters which are typically made by reacting a dicarboxylic acid or ester forming derivative thereof with a glycol to form the his-glycol esters of the acid. The ester is then typically condensed at elevated temperature and reduced pressure to eliminate excess glycol and produce the glycol ester polymer of the dicarboxylic acid. Suitable glycols used in the manufacture of fiber forming polyester include, e.g., ethylene glycol, diethylene glycol, polyethylene glycol or other alkylene glycols, including mixtures thereof. Of the dicarboxylic acids, terephthalic acid is commonly used in the manufacture of fiber-forming polyester, although a portion of the terephthalic acid may be replaced by one or more other dicarboxylic acids, such as adipic acid, sebacic acid, isophthalic acid and the like.

In use, the soil release composition of the invention is typically formulated as an aqueous dispersion containing at least about 60% by weight of water and 40% by weight or less of soil release composition, more typically from about 70 to about 90% by weight water and 10 to 30 weight percent soil release composition. Preferably, the aqueous dispersion contains about 85% by weight water and the balance, i.e., 15% by weight active material, i.e., the thermal stabilizer-containing copolymeric soil release material.

The invention composition may be applied to the polyester textile by any conventional technique, e.g., padding pressure jet, dye vat, or the like. Regardless of the mode of application, a sufficient amount of the thermally stabilized soil release composition is applied to or finished on the polyester textile so as to provide from about 0.3 to about 1.5% by weight, and preferably from about 0.5 to about 0.9% by weight, of the active soil release composition, i.e., undiluted soil release composition, based on the weight of polyester textile undergoing treatment. The soil release composition of the invention is compatible with other typically used polyester textile treatments or conditioning materials such as, for example, dyes, dye carriers, defoamers, anti-cracking aids, brightening agents, other antioxidant materials, and the like.

The invention is further illustrated, but is not intended to be limited, by the following Example.

EXAMPLE

A series of Novolak resin products were evaluated for their ability to thermally stabilize the copolymeric soil release material, Larosol® 214A. The molecular weight and hydroxyl numbers of the products are listed in Table 1.

TABLE 1

| Novolak Resin Product | Hydroxyl No.[c] | MW (WA)[a] | MW (NA)[b] |
|---|---|---|---|
| A | 504 | 900 | 494 |
| B | 528 | 1747 | 745 |
| C | 523 | 1733 | 744 |
| D | 481 | 975 | 652 |

[a](WA) denotes Weight Average Molecular Weight.
[b](NA) denotes Number Average Molecular Weight.
[c]Hydroxyl No. was determined using American Oil Chemists Society official method Cd 13-60.

The Novolak resin products of Table 1 were used to prepare the compositions of Samples 3-6. Except for Sample 7, the following listed samples were aqueous dispersions of soil release polymer compositions comprising about 85% by weight distilled water and about 15% by weight of the indicated soil release polymer composition.

Sample 1 contained about 15% by weight of Larosol® 214A soil release polymer.

Sample 2 contained about 15% by weight of Milease® T soil release polymer.

Sample 3 contained about 15% by weight of a composition containing 97.5% Larosol® 214A and 2.5% Novolak resin Product D.

Sample 4 contained about 15% by weight of a composition containing 97.5% Larosol® 214A and 2.5% Novolak resin Product B.

Sample 5 contained about 15% by weight of a composition containing 97.5% Larosol® 214A and 2.5% Novolak resin Product A.

Sample 6 contained about 15% by weight of a composition containing 97.5% Larosol® 214A and 2.5% Novolak Product C.

Sample 7 contained distilled water.

An Atlas Model LHTP Launder-ometer having 200 milliliter (ml) capacity, Type 7 stainless steel high pressure specimen containers, and polyethylene glycol as the heat transfer medium was used to perform the hereinafter described evaluations. Samples 1-6 were further diluted with water to a 10% by weight dispersion of the soil release polymer composition. A specimen container was charged with the following: 115.7 ml deionized water, 2.55 ml of a 10 weight percent aqueous mixture of perchloroethylene (dye carrier), 0.5 ml of a 10 weight percent aqueous mixture of Defoamer DP from Crucible Chemical, and 6.25 ml of the 10 weight percent aqueous dispersion of the selected sample of the soil release polymer composition. Sample 7 (control) was used in the same way as Samples 1-6. No dye was added to the specimen containers. The pH of the resulting aqueous bath in each container was adjusted to 4.5-5.0 with sodium carbonate.

Separate 6 inch×18 inch (15.4 cm×45.72 cm) swatches of white Dacron® Type 54 100% polyester fabric, each swatch weighing about 12.5 grams were used in the evaluations. This size swatch enabled the testing of up to 3 individual 6 inch×6 inch (15.4 cm×15.4 cm) swatches for soil release characteristics after a selected number of wash cycles. The fabric swatches were charged to the specimen containers and the containers sealed. The containers were mounted in the Launder-ometer and the contents heated to about 265° F. (129° C.) at a rate of about 10° F. (5.6° C.) per minute. The temperature of the containers was maintained for about 30 minutes at 265° F. (129° C.), and the containers then cooled to about 120° F. (49° C.). The fabric swatches were removed from the containers, rinsed, tumble dried and lightly pressed with an iron. Prior to testing, the swatches were wet with water to simulate mill conditions, and run through a laboratory padder, manufactured by Werner Mathis of Switzerland, at 6 bars ($6\times10^5$ Newtons/meter$^2$) of pressure. The slightly wet swatches were heat set at 395° F. (202° C.) for 3 minutes in a forced air oven, lightly pressed and allowed to condition for 30 minutes prior to spotting with oil.

The first 6 inch×6 inch (15.4 cm×15.4 cm) section of each fabric swatch was spotted in the center with 5 drops of used filtered crankcase motor oil, which oil was allowed to wick into the fabric until the spot reached the size of a one inch (2.54 cm) circle. The fabric swatches were then washed and rinsed in a conventional home washing machine on the permanent press setting with 120° F. (49° C.) wash and rinse water using 90 grams of AATCC Standard Laundry Detergent 124. Subsequently, the swatches were dried in a conventional home electric dryer for about 45 minutes at the Normal dry setting. The oil spotted section was cut from the swatch and the remaining 6 inch×12 inch (15.4×30.8 cm) swatch was washed two times more as before without drying between cycles, and then washed a third time and dried using the same settings as before. The left 6 inch×6 inch (15.4×15.4 cm) section of the swatch was spotted with oil at its center as before and then washed and dried once as before. The oil spotted section was cut from the swatch. No further testing was done on the remaining unspotted section of the swatch. The fabric swatches were then visually evaluated for soil release properties and durability, i.e., soil release as a function of the number of washing/drying cycles.

More particularly, the soil release properties of the fabric swatches were evaluated using the following rating scale:

1 (Total Failure)—This represents total failure of the system. Not only is oil not released, the fiber reverts to a hydrophobic nature and oil migrates across the fiber.

2 (Failure)—A rating of 2 is representative of little or no release of oil. Adjacent fiber still maintains enough hydrophilic or soil release properties to inhibit the migration of oil to that area.

3 (Partial Failure)—A rating of 3 is the minimal acceptable rating. In this case, not all of the oil is released from the original spot, but strips and uneven removal occurs. Extended washing will remove the spots. The fiber is still hydrophilic.

4 (Release)—A rating of 4 is a completely acceptable rating indicating that oil is released with only a slight shadow remaining from where the spot was at originally. This rating is also indicative of a high level of hydrophilicity.

5 (Total Release)—A rating of 5 is the best and reflects total release of the oil. Oil is completely released with no shadow remaining to indicate the original area of the test spot. This rating is also indicative of a high level of hydrophilicity.

+/− Is used to indicate further gradations of the ratings in either the positive of negative direction.

Table 2 summarizes the duplicate rating of the test swatches of Dacron® 54 treated in accordance with this Example.

TABLE 2

| Sample No. | No. of Wash Cycles Initial | 5 |
|---|---|---|
| 1 | 1,1 | 1,1 |
| 2 | 1,1 | 1,2+ |
| 3 | 4,4* | 4,4−* |
| 4 | 4,4 | 3+,2+ |
| 5 | 4,4 | 3−,3− |
| 6 | 4,4 | 3,3 |
| 7 | 1,1− | 1,1 |

*Denotes that the swatches turned yellow in color.

The results of Table 2 show that Larosol® 214A (Sample 1) and Milease® T (Sample 2) failed as did the distilled water (Sample 7). The swatches treated with Samples 4, 5 and 6 provided good soil release yielding ratings of 4 after the initial wash. These swatches also showed good durability after 5 washes since most of them had at least one soil release rating of 3. The swatches treated with Sample 3 discolored the white fabric. This sample also provided the most effective soil release and durability properties after 5 washes. Therefore, soil release compositions stabilized with Novolak resin Product D may be more suitable for use on non-white polyester textile fabrics.

Although the invention has been described in some detail by the foregoing, it is to be understood that many variations may be made therein by those skilled in the art without departing from the spirit and scope thereof as defined in the appended claims.

What is claimed is:

1. A composition comprising a non-fiber forming polyether-polyester copolymer and a thermal stabilizing amount of novolak phenol-formaldehyde resin having a hydroxyl number in the range of from about 200 to about 1000 and a weight average molecular weight in the range of about 400 to about 3000.

2. The composition of claim 1 wherein the polyether-polyester copolymer is a polyethylene terephthalate-polyoxyethylene terephthalate copolymer.

3. The composition of claim 1 wherein the Novolak phenol-formaldehyde resin is present in the composition in an amount ranging from about 0.5 to about 5.0 weight percent, based on the weight of the polyether-polyester copolymer.

4. The composition of claim 2 wherein the novolak phenol-formaldehyde resin is present in the composition in an amount ranging from about 0.75 to about 2.5 weight percent based on the weight of the polyethylene terephthalate-polyoxyethylene terephthalate copolymer.

5. The composition of claim 4 wherein the Novolak resin has a hydroxyl number of from about 400 to about 600, and a weight average molecular weight of from about 750 to 2000.

6. The composition of claim 2 wherein the copolymer contains from about 10 to about 50% by weight of ethylene terephthalate repeat units and from about 90 to about 50% by weight of polyoxyethylene terephthalate repeat units derived from a polyoxyethylene glycol having an average molecular weight of from about 1000 to about 4000, and wherein the ratio of ethylene terephthalate repeat units to polyoxyethylene terephthalate repeat units is from about 2:1 to about 6:1.

7. The composition of claim 6 wherein the novolak resin is present in the composition in an amount of from about 0.5 to about 5.0 weight percent, based on the weight of the polyethylene terephthalate-polyoxyethylene terephthalate copolymer.

8. A composition of from about 70 to about 90 weight percent water and from about 10 to about 30 weight percent of the composition of claim 1.

9. A composition of from about 70 to about 90 weight percent water and from about 10 to about 30 weight percent of the composition of claim 4.

10. A composition of from about 70 to about 90 weight percent water and about 10 to about 30 weight percent of the composition of claim 6.

11. An article comprising synthetic polymeric textile having applied to or finished thereon a soil release composition comprising a non-fiber forming polyether-polyester copolymer and a thermal stabilizing amount of a novolak phenol-formaldehyde resin having a hydroxyl number of from about 200 to about 1000 and a weight average molecular weight of from about 400 to about 3000.

12. The article of claim 11 wherein the synthetic polymeric textile is a polyester textile.

13. The article of claim 12 wherein the polyester textile is predominantly a copolymer of ethylene glycol and terephthalic acid.

14. The article of claim 12 wherein the polyether-polyester copolymer is a polyethylene terephthalate-polyoxyethylene terephthalate copolymer.

15. The article of claim 14 wherein the novolak resin is present in the soil release composition in an amount ranging from about 0.5 to about 5.0 weight percent, based on the weight of the polyether-polyester copolymer.

16. The article of claim 11 wherein from about 0.3 to about 1.5 weight percent of the soil release composition, based on the weight of the textile, is present on the textile.

17. The article of claim 14 wherein the novolak resin is present in the composition in an amount ranging from about 0.75 to about 2.5 weight percent, based on the weight of the polyether-polyester copolymer, and the novolak resin has a hydroxyl number of from about 400 to about 600, and a weight average molecular weight of from about 750 to 2000.

* * * * *